US007480946B1

(12) United States Patent
Brown

(10) Patent No.: US 7,480,946 B1
(45) Date of Patent: Jan. 27, 2009

(54) HOT TUB COVER ASSEMBLY

(76) Inventor: David E. Brown, 47 Circle Dr. East, Montgomery, IL (US) 60538

( * ) Notice: Subject to any disclaimer, the term of this patent is extended or adjusted under 35 U.S.C. 154(b) by 504 days.

(21) Appl. No.: 11/237,280

(22) Filed: Sep. 29, 2005

(51) Int. Cl.
*E04H 4/00* (2006.01)

(52) U.S. Cl. ..... 4/498

(58) Field of Classification Search ..... 4/498; 135/143, 148, 151; 296/26.01, 169, 173
See application file for complete search history.

(56) References Cited

U.S. PATENT DOCUMENTS 2,798,760 A * 7/1957 Hille ..... 296/173
2,843,418 A * 7/1958 Gray ..... 296/173
3,184,261 A 5/1965 Young
3,514,148 A * 5/1970 Hunter et al. ..... 296/170
3,566,420 A 3/1971 Peterson et al.
3,770,314 A * 11/1973 Borskey ..... 296/176
3,924,889 A * 12/1975 Gogush ..... 296/176
D299,959 S 2/1989 Montgomery
5,745,932 A 5/1998 Barovetto
6,325,447 B1 12/2001 Kuo
6,718,566 B1 * 4/2004 Wilson ..... 4/498

* cited by examiner

*Primary Examiner*—Charles E Phillips

(57) ABSTRACT

A hot tub cover assembly includes a hot tub that includes a bottom wall and a peripheral wall. The peripheral wall includes a first side wall, a second side wall, a third side wall and a fourth side wall wherein the first and second side walls are positioned opposite of each other. The peripheral wall has an upper edge defining an opening into the hot tub. A panel has a size and shape substantially equal to the upper edge of the peripheral wall. A lifting assembly is attached to and extends between the peripheral wall and the canopy. The lifting assembly is configured to selectively lift the canopy into an open position lifted above and spaced from the hot tub or lower the canopy into a closed position abutting the upper edge and covering the opening.

2 Claims, 5 Drawing Sheets

HOT TUB COVER ASSEMBLY

BACKGROUND OF THE INVENTION

1. Field of the Invention

The present invention relates to spa covering devices and more particularly pertains to a new spa covering device for selectively covering and sealing an opening of a hot tub.

2. Description of the Prior Art

The use of spa covering devices is known in the prior art. U.S. Pat. No. 6,716,566 describes a device that including a plurality of legs each selectively extendable upwardly or downwardly with respect to a spa. Another type of spa covering device in U.S. Pat. No. 5,745,932 having a structure adapted for selectively closing a spa. A spa enclosure is found in U.S. Patent Des. No. 299,959.

While these devices fulfill their respective, particular objectives and requirements, the need remains for a device that can be retrofitted to existing spas by attaching legs to an outer surface of the spa. It is preferred that the device selectively lift a canopy upwardly over a spa to form a spaced covering while the spa is being used and which will lower a canopy to seal the spa when it is not being used. This will allow the canopy to perform a dual purpose.

SUMMARY OF THE INVENTION

The present invention meets the needs presented above by generally comprising a hot tub that includes a bottom wall and a peripheral wall. The peripheral wall includes a first side wall, a second side wall, a third side wall and a fourth side wall wherein the first and second side walls are positioned opposite of each other. The peripheral wall has an upper edge defining an opening into the hot tub. A panel has a size and shape substantially equal to the upper edge of the peripheral wall. A lifting assembly is attached to and extends between the peripheral wall and the canopy. The lifting assembly is configured to selectively lift the canopy into an open position lifted above and spaced from the hot tub or lower the canopy into a closed position abutting the upper edge and covering the opening.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
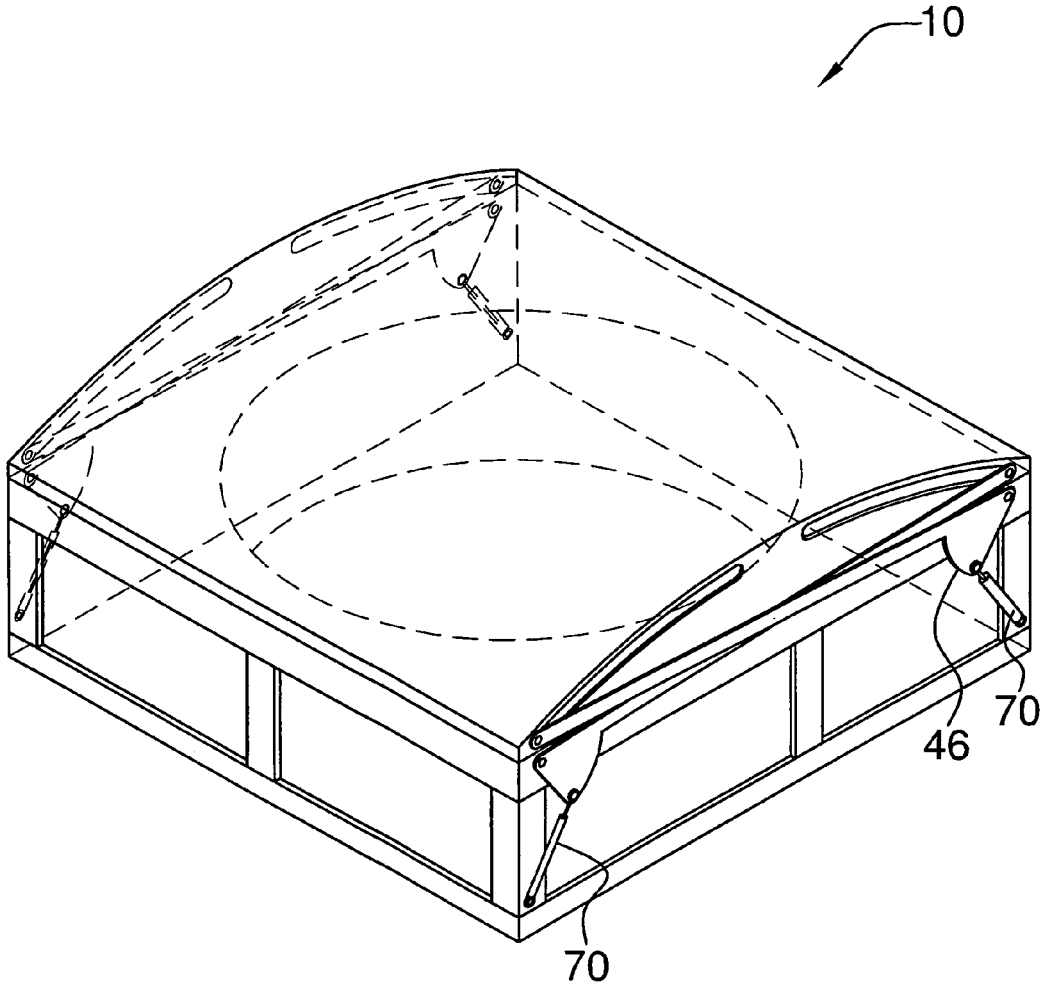
FIG. 1 is a perspective view of a hot tub cover assembly according to the present invention.
Figure 2:
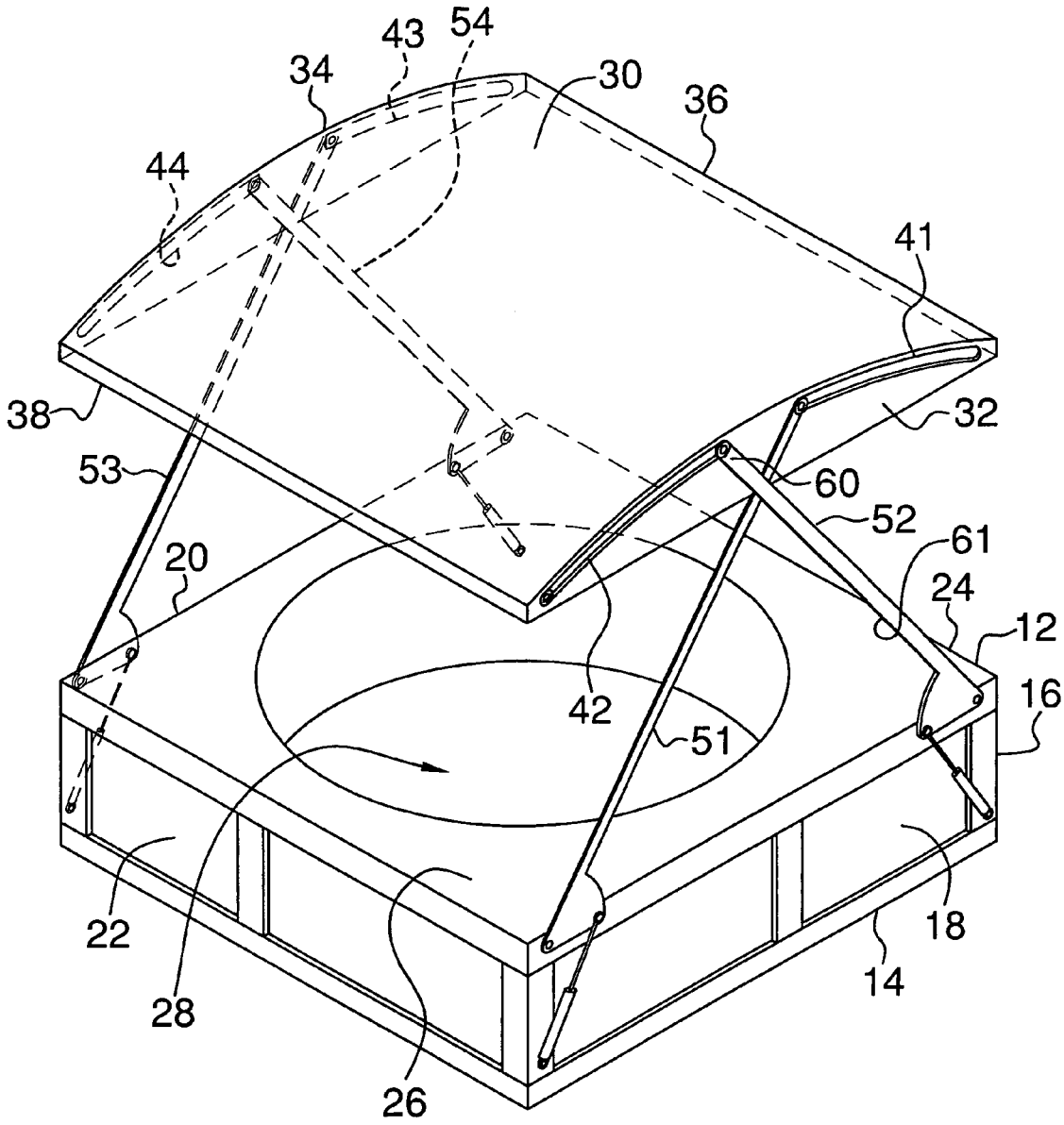
FIG. 2 is a perspective view of the present invention.
Figure 3:
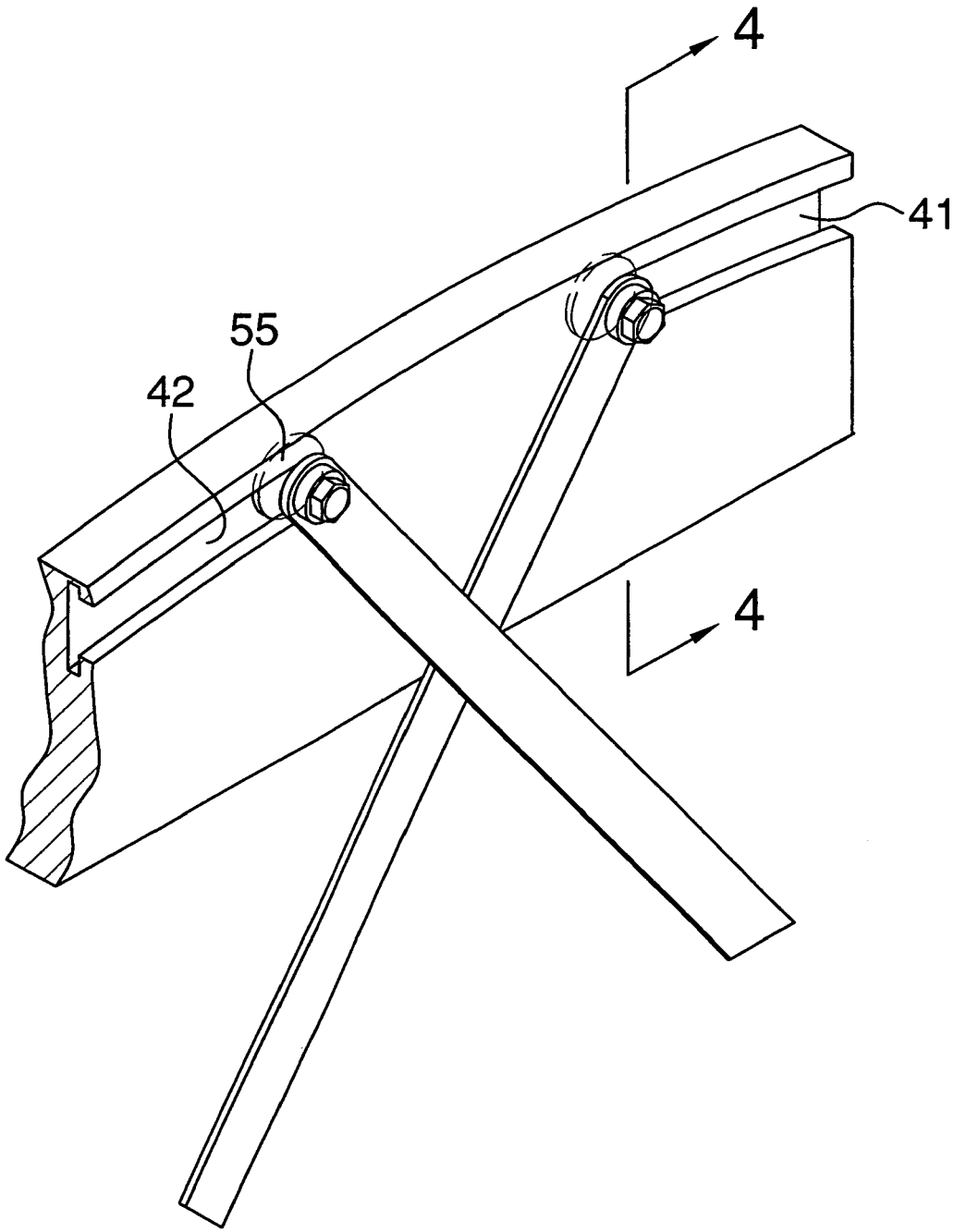
FIG. 3 is an enlarged perspective view of a coupler of the present invention.
Figure 4:
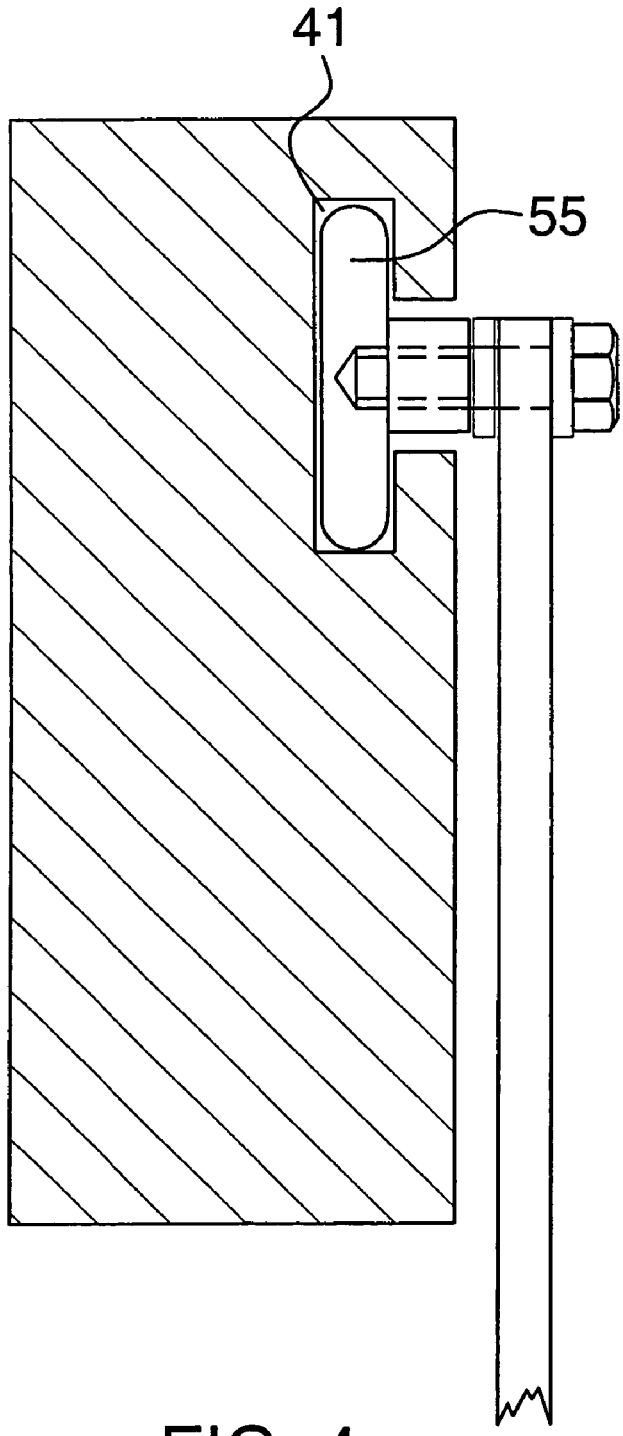
FIG. 4 is a cross-sectional view taken along line 4-4 of FIG. 3 of the present invention.
Figure 5:
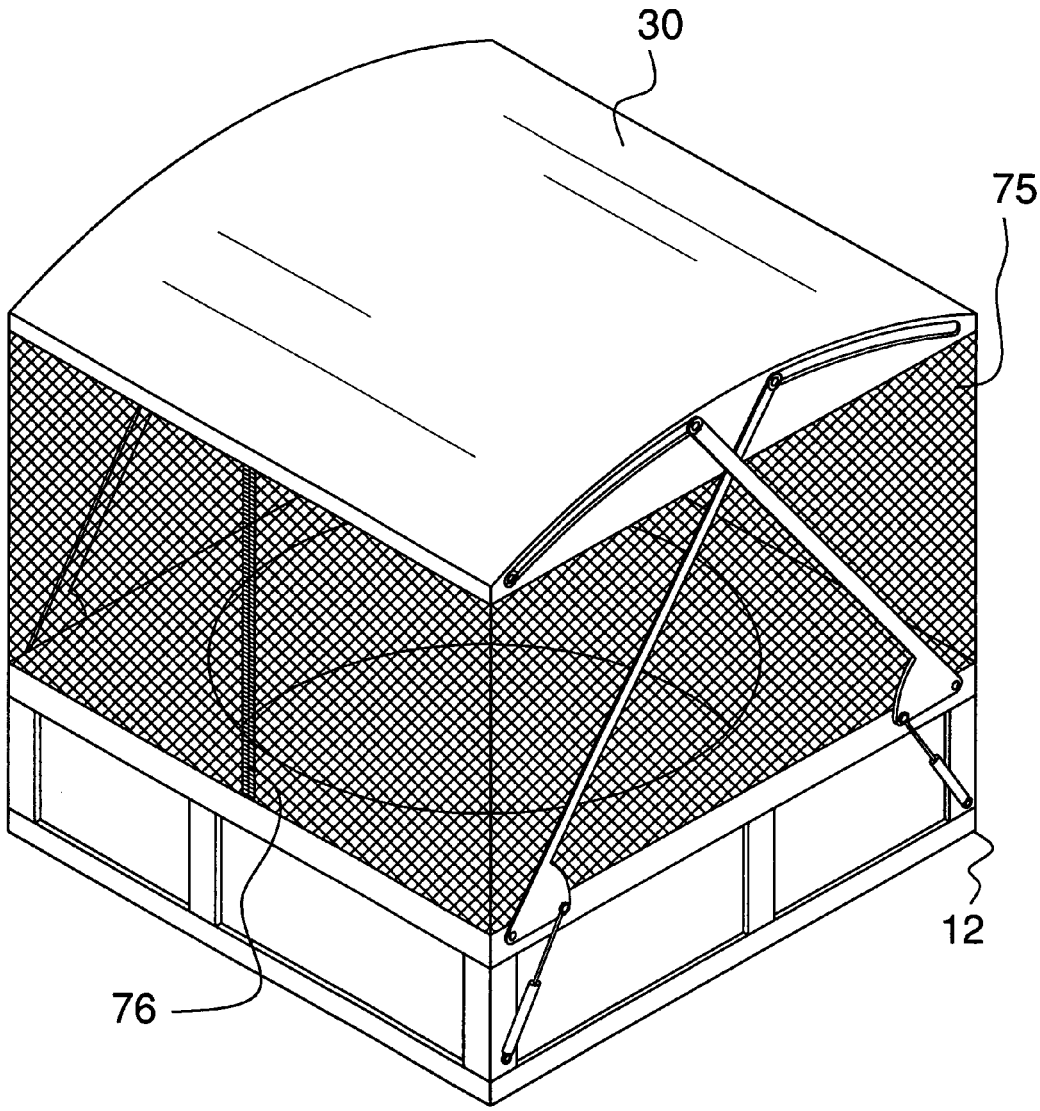
FIG. 5 is top perspective view taken of the present invention.

With reference now to the drawings, and in particular to FIGS. 1 through 4 thereof, a new spa covering device embodying the principles and concepts of the present invention and generally designated by the reference numeral 10 will be described.

As best illustrated in FIGS. 1 through 4, the hot tub cover assembly 10 generally comprises a conventional hot tub 12 that has a bottom wall 14 and a peripheral wall 16. The peripheral wall 16 includes a first side wall 18, a second side wall 20, a third side wall 22 and a fourth side wall 24 wherein the first 18 and second 20 side walls are positioned opposite of each other. The peripheral wall 16 has an upper edge 26 defining an opening 28 into the hot tub 12.

A panel 30 has a size and shape substantially equal to the upper edge 26 of the peripheral wall 16. The panel 30 has a first lateral edge 32, a second lateral edge 34, a third lateral edge 36 and a fourth lateral edge 38 wherein the first 32 and second 34 lateral edges are positioned opposite of each other. The first lateral edge 32 has a first slot 41 and a second slot 42 therein. The first slot 41 extends from the third lateral edge 36 toward the fourth lateral edge 38. The second slot 42 extends from the fourth lateral edge 38 toward the third lateral edge 36. The second lateral edge 34 has a third slot 43 and a fourth slot 44 therein. The third slot 43 extends from third lateral edge 36 toward the fourth lateral edge 38. The fourth slot 38 extends form the fourth lateral edge 38 toward the third lateral edge 36.

A lifting assembly 46 is attached to and extends between the peripheral wall 16 and the canopy 30. The lifting assembly 46 is configured to selectively lift the canopy 30 into an open position lifted above and spaced from the hot tub 12 or lower the canopy 30 into a closed position abutting the upper edge 26 and covering the opening 28.

The lifting assembly 46 includes a first set of legs including a first leg 51 and a second leg 52. Each of the first 51 and second 52 legs has an upper end 60 and a lower end 61. Each of the lower ends 61 is pivotally coupled to the first side wall 18. The lower end 61 of the first leg 61 is positioned adjacent to the third wall 22 and the lower end 61 of the second leg 52 is positioned adjacent to the fourth wall 24.

A second set of legs includes a third leg 53 and a fourth leg 54. Each of the third 53 and fourth 54 legs has an upper end 60 and a lower end 61. Each of the lower ends 61 of the third 53 and fourth 54 legs is pivotally coupled to the second side wall 20. The lower end 61 of the third leg 53 is positioned adjacent to the third wall 22 and the lower end 61 of the fourth leg 54 is positioned adjacent to the fourth wall 24.

A plurality of couplers 55 is provided. Each of the couplers 55 is mounted in and is positionable along a length of one of the first 41, second 42, third 43 and fourth 44 slots. The coupler 55 in the first slot 41 is rotatably coupled to the upper end 60 of the first leg 51 and the coupler 55 in the second slot 42 is rotatably coupled to the upper end 60 of the second leg 52. The coupler 55 in the third slot 43 is rotatably coupled to the top end 60 of the third leg 53 and the coupler 55 in the fourth slot 44 is rotatably coupled to the top end 60 of the fourth leg 54. The couplers 55 comprise wheels which can rotate and thereby move along a length of the slots.

A plurality of bracing members 70 is attached to the hot tub 12 and is configured to brace the panel 30 is an open position.

Each of the branching members 70 is attached to one of the legs 51-55. The bracing members 70 each comprise pneumatic piston assembly.

A flexible perimeter screen 75 may be attached to and extended between canopy 30 and the hot tub 12. An access point, closable by a zipper 76, preferably extends through the perimeter screen 75 and generally extends between the canopy 30 and the hot tub 12 to allow selective access through the screen 75 and into the hot tub 12. The screen 75 prevents insects form having access to persons in the hot tub 12.

In use, the assembly 10 allows a person to use a hot tub 12 or spa in conventional manner by lifting the canopy 30 upwardly over the hot tub 12. The canopy 30 forms a roof over the hot tub 12 in this orientation. When not being used, the canopy 30 is lowered to seal the hot tub 12 to retain the hot tub's heat and to prevent insects or debris from entering the hot tub 12.

With respect to the above description then, it is to be realized that the optimum dimensional relationships for the parts of the invention, to includes variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hot tub and cover apparatus comprising:

a hot tub including a bottom wall and a peripheral wall, said peripheral wall including a first side wall, a second side wall, a third side wall and a fourth side wall wherein said first and second side walls are positioned opposite of each other, said peripheral wall having an upper edge defining an opening into said hot tub;

said cover apparatus comprising; a panel having a size and shape substantially equal to said upper edge of said peripheral wall, said panel having a first lateral edge, a second lateral edge, a third lateral edge and a fourth lateral edge wherein said first and second lateral edges are positioned opposite of each other, said first lateral edge having a first slot and a second slot therein, said first slot extending from said third lateral edge toward said fourth lateral edge, said second slot extending from said fourth lateral edge toward said third lateral edge, said second lateral edge having a third slot and a fourth slot therein, said third slot extending from third lateral edge toward said fourth lateral edge, said fourth slot extending from said fourth lateral edge toward said third lateral edge;

a lifting assembly being attached to and extending between said peripheral wall and said panel, said lifting assembly being configured to selectively lift said panel into an open position lifted above and spaced from said hot tub or lower said panel into a closed position abutting said upper edge and covering said opening, said lifting assembly including:

a first set of legs including a first leg and a second leg, each of said first and second legs having an upper end and a lower end, each of said lower ends being pivotally coupled to said first side wall, said lower end of said first leg being positioned adjacent to said third wall, said lower end of said second leg being positioned adjacent to said fourth wall;

a second set of legs including a third leg and a fourth leg, each of said third and fourth legs having an upper end and a lower end, each of said lower ends of said third and fourth legs being pivotally coupled to said second side wall, said lower end of said third leg being positioned adjacent to said third wall, said lower end of said fourth leg being positioned adjacent to said fourth wall;

a plurality of couplers, each of said couplers being mounted in and being positionable along a length of one of said first, second, third and fourth slots, said coupler in said first slot being rotatably coupled to said upper end of said first leg, said coupler in said second slot being rotatably coupled to said upper end of said second leg, said coupler in said third slot being rotatably coupled to said top end of said third leg, said coupler in said fourth slot being rotatably coupled to said top end of said fourth leg, each of said slots being arcuate; and members being attached to one of said legs, each of said bracing members comprising a pneumatic piston assembly.

2. The apparatus according to claim 1, further including a plurality of bracing members being attached to said hot tub and being configured to brace said panel in an open position, each of said bracing members being attached to one of said legs, each of said bracing members comprising a pneumatic piston assembly.

* * * * *